US005265423A

United States Patent [19]

Glaser

[11] Patent Number: 5,265,423

[45] Date of Patent: Nov. 30, 1993

[54] AIR-OIL PRESSURE INTENSIFIER WITH ISOLATION SYSTEM FOR PROHIBITING LEAKAGE BETWEEN AND INTERMIXING OF THE AIR AND OIL

[75] Inventor: Michael Glaser, Ontario, Canada

[73] Assignee: Power Products Ltd., Woodbridge, Canada

[21] Appl. No.: 985,325

[22] Filed: Dec. 4, 1992

[51] Int. Cl.[5] ..... F15B 7/00

[52] U.S. Cl. ..... 60/560; 60/563; 92/80; 92/86; 92/151; 92/165 PR

[58] Field of Search ..... 92/112, 86, 165, 165 PR, 92/150, 162 R, 162 P, 80, 82, 166; 60/560, 563, 583, 593

[56] References Cited

U.S. PATENT DOCUMENTS

| | | | |
|---|---|---|---|
| 2,811,950 | 11/1957 | Entz | 92/86 |
| 2,976,845 | 3/1961 | Goldring | 92/86 |
| 3,282,167 | 1/1966 | McKenzie | 92/166 |
| 3,426,530 | 2/1969 | Georgelin | 60/560 |
| 3,815,481 | 6/1974 | Pauliukonis | 92/86 |
| 3,962,956 | 6/1976 | Jacobellis | 92/112 |
| 4,300,351 | 11/1981 | Grüllmeier | 60/560 |
| 5,040,369 | 8/1991 | Rapp | 60/560 |

FOREIGN PATENT DOCUMENTS

| | | | |
|---|---|---|---|
| 2304752 | 8/1974 | Fed. Rep. of Germany | 60/560 |

*Primary Examiner*—Thomas E. Denion
*Attorney, Agent, or Firm*—Bachman & LaPointe

[57] ABSTRACT

The present invention is drawn to an isolation system for separating two diverse fluid mediums from each other and, more particularly, an isolation system for prohibiting leakage of the diverse mediums around the peripheral surface of a piston movably mounted within a chamber. The present invention further relates to an improved multi-piston air-oil pressure intensifier employing the improved isolation system for separating and preventing leakage of the air and oil mediums during operation of the pressure intensifier.

22 Claims, 5 Drawing Sheets

AIR-OIL PRESSURE INTENSIFIER WITH ISOLATION SYSTEM FOR PROHIBITING LEAKAGE BETWEEN AND INTERMIXING OF THE AIR AND OIL

BACKGROUND OF THE INVENTION

The present invention is drawn to an isolation system for separating two fluid mediums from each other and, more particularly, an isolation system for prohibiting leakage of the fluid mediums around the peripheral surface of the piston movably mounted within a chamber.

Multi-piston air-oil pressure intensifiers providing two distinct pressure steps are known in the prior art. See, for example, U.S. Pat. Nos. 4,271,671, 4,300,351 and 4,993,226. Heretofore, the prior art pressure intensifiers, particularly air-oil pressure intensifiers, have suffered from a continuing problem dealing with leakage between the oil containing compartment and air compartments of the intensifier. As one of the mediums, oil, is substantially incompressible and the other medium, air, is readily compressible, leakage between and intermixing of the air and oil effects the efficiency of the air-oil pressure intensifier. Various mechanisms have been proposed for sealing the oil compartment of the air-oil pressure intensifier from the air compartments of same; however, to date known prior art systems have not proven to be entirely satisfactory.

Naturally, it would be highly desirable to provide a system in a multi-piston air-oil pressure intensifier for isolating the two fluid mediums (air and oil) from each other and to prohibit leakage of the fluid mediums around the peripheral surface of a piston of the pressure intensifier thereby eliminating any intermixing of the air and oil mediums.

Accordingly, it is a principal object of the present invention to provide an isolation system for separating two diverse fluid mediums from each other.

It is a particular object of the present invention to provide an isolation system as set forth above which prohibits leakage between and intermixing of two diverse fluid mediums.

It is a further object of the present invention to provide an isolation system as aforesaid for prohibiting leakage of diverse fluid mediums around the peripheral surface of a piston movably mounted within a chamber.

It is a still further object of the present invention to provide an isolation system as aforesaid for prohibiting leakage between air and oil compartments of a multi-piston air-oil pressure intensifier.

Further objects and advantages of the present invention will appear herein below.

SUMMARY OF THE INVENTION

The present invention is drawn to an isolation system for separating two diverse fluid mediums from each other and, more particularly, an isolation system for prohibiting leakage of the diverse mediums around the peripheral surface of a piston movably mounted within a chamber. The present invention further relates to an improved multi-piston air-oil pressure intensifier employing the improved isolation system for separating and preventing leakage of the air and oil mediums during operation of the pressure intensifier.

In accordance with the present invention, a system for isolating two diverse fluid mediums in a chamber so as to prohibit intermixing of the diverse fluid mediums comprises a housing defining a chamber, the housing including a substantially cylindrical elongated side wall and a pair of opposed end walls which define with the side wall the chamber. A piston movably mounted within the chamber divides the chamber into a first fluid medium compartment (air) and a second fluid medium compartment (oil). The piston is provided with a first end face, a second end face and a peripheral wall surface extending between the first end face and the second end face. The peripheral wall surface seals with the side wall of the housing for separating and sealing the first compartment from the second compartment. In accordance with the present invention, the peripheral wall surface is provided with a continuous annular recess formed therein which defines with the side wall of the housing an enclosed annular space between the end faces of the piston. A conduit is provided for communicating the enclosed annular space with a location or area external of the housing for creating a pressure differential between the enclosed annular space and the area external of the housing which allows fluid medium in the annular space to escape to the external location thereby prohibiting the fluid medium in one of the first medium compartments from leaking into the other fluid medium compartment. In accordance with a preferred embodiment of the present invention, the conduit is in the form of a flexible tube mounted within one of the fluid medium compartments between the piston and the housing for connecting the enclosed annular space with the vacuum source.

The isolation system of the present invention is particularly useful in air-oil pressure intensifiers which employ air and oil for sequentially applying pressure to the ram of the intensifier for performing work on a workpiece. It has been found that, in accordance with the present invention, the isolation system as set forth above is effective for prohibiting leakage between and intermixing of the air and oil mediums.

Further objects and advantages of the present invention will become apparent herein below.

DETAILED DESCRIPTION

Figure 1:
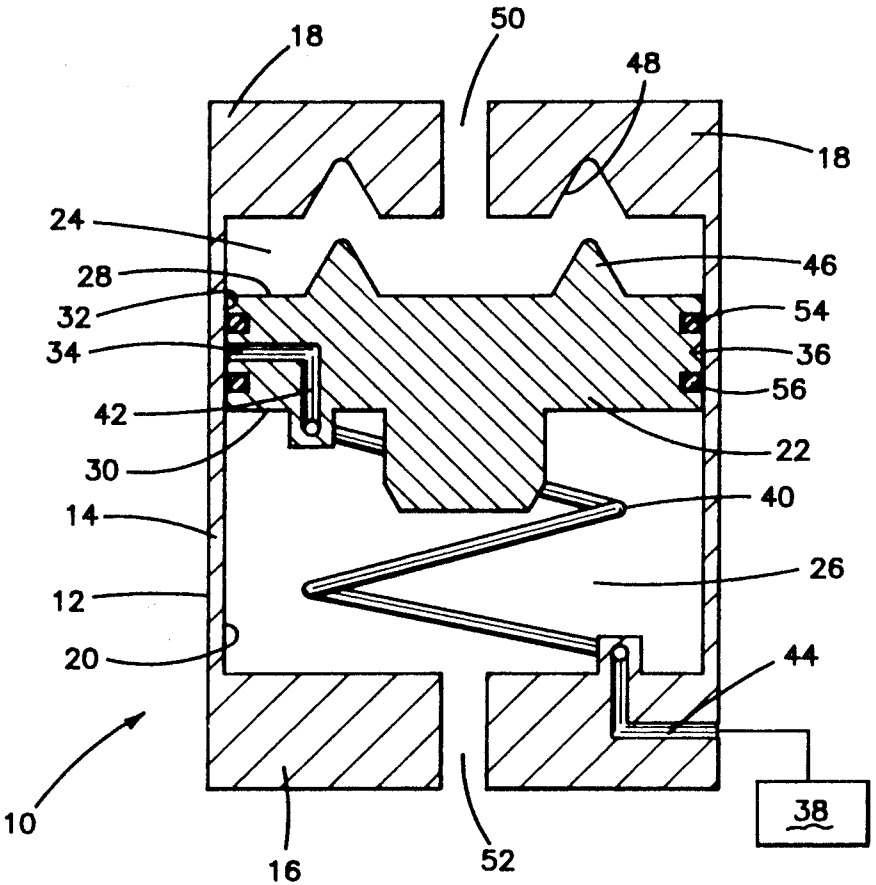
FIG. 1 is a sectional view of a first embodiment of the isolation system of the present invention.

With reference to the drawings, FIG. 1 is a cross sectional view of a first embodiment of an isolation system 10 in accordance with the present invention. The isolation system 10 includes a housing 12 comprising a substantially cylindrical elongated side wall 14 and a pair of opposed end walls 16 and 18 which define with the substantially cylindrical side wall 14 a chamber 20. A piston 22 is movably mounted within the chamber 20 and divides the chamber 20 into a first fluid medium compartment 24 and a second fluid medium compartment 26. The piston 22 has a first end face 28 and a second end face 30 which face end walls 18 and 16 respectively and define therewith, and with substantially cylindrical side wall 14, the first and second fluid medium compartments 24 and 26. The piston 22 is provided with a peripheral wall surface 32 extending between the end faces 28 and 30. The peripheral wall surface 32 sealingly mates with the inner surface of side wall 14 for sealing the first fluid medium compartment 24 from the second fluid medium compartment 26.

In accordance with the present invention, the peripheral wall surface 32 is provided with a continuous annular recess 34 formed on the peripheral wall. The annular recess 34 defines with the peripheral surface 32 of piston 22 and side wall 14 of housing 12 an enclosed annular space 36 between the end faces 28 and 30 of the piston. The enclosed annular space 36 is communicated with a low pressure area 38 located exteriorly of housing 12. By low pressure area is meant a pressure which is less than the pressure present in the space defined between seals 54 and 56 and containing enclosed annular space 36. Thus, a pressure differential is created which allows any of the fluid mediums which might leak past the seals 54 and 56 to escape annular space 36 to the exterior of the housing 12, i.e., area 38. It is preferred that area 38 be at atmospheric pressure or below. Thus, the enclosed annular space is communicated with an area located external of the housing which is at a lower pressure than any pressure build up which may occur in the space between the seals as a result of leakage of the medium from either compartment past the seals and into the annular space. The externally located area is normally at normal room atmospheric pressure; however, it may be at lower pressures. The only requirement is that the pressure defferential described above be accomplished.

In accordance with one embodiment of the present invention the enclosed annular space 36 is communicated with the area 38 by means of a flexible tube 40 which is mounted in fluid medium compartment 26. The flexible tube 40 communicates with passage 42 formed within the piston 22 for communicating space 36 with flexible tube 40. A conduit 44 is formed in end wall 16 for communicating the flexible conduit 40 with the low pressure area 38. The connection between the flexible conduit 40 and piston 22 and housing 12 may be made by any suitable means known in the art and the particular mechanism for connecting the flexible tube 40 to the piston and passage 42 and the housing and passage 44 forms no part of the instant invention. In addition, while FIG. 1 illustrates conduit 44 to be located in end wall 16 it should be appreciated that the conduit 44 can as easily be located in the side wall 14 if desired.

In accordance with a further preferred feature of the present invention, end face 28 of piston 22 may be provided with one or more guide pins 46 which are adapted to be received in recesses 48 in end wall 18 for locating the piston. The pins 46 and recesses 48 align the piston 22 within housing 12, thus preventing a tangling of the flexible conduit 40.

Fluid medium compartments 24 and 26 may each be charged with a fluid via inlets 50 and 52. Suitable valves, not shown, control the flow of the fluid mediums into and out of compartments 24 and 26. As noted above, suitable piston seals 54 and 56 are provided on the peripheral surface of piston 22 on either side of enclosed annular space 36 for improving the seal of the piston within housing 12.

The isolation system of the present invention, as illustrated in FIG. 1, which provides for an annular recess and enclosed annular space on the peripheral surface of a piston member separating two diverse fluids in a housing, prohibits leakage between the fluid medium compartments around the peripheral surface of the piston and thus prohibits intermixing of the diverse fluid mediums. Any leakage from either of the fluid compartments between the interface of the piston and cylinder wall would be drawn off to area 38 when the fluid communicated with enclosed annular space 36. By drawing off the fluid via conduit 40 from the annular space 36, the fluid is prohibited from leaking between the fluid medium compartments thereby prohibiting an intermixing of the diverse fluid mediums contained in the compartments.

Figure 2:
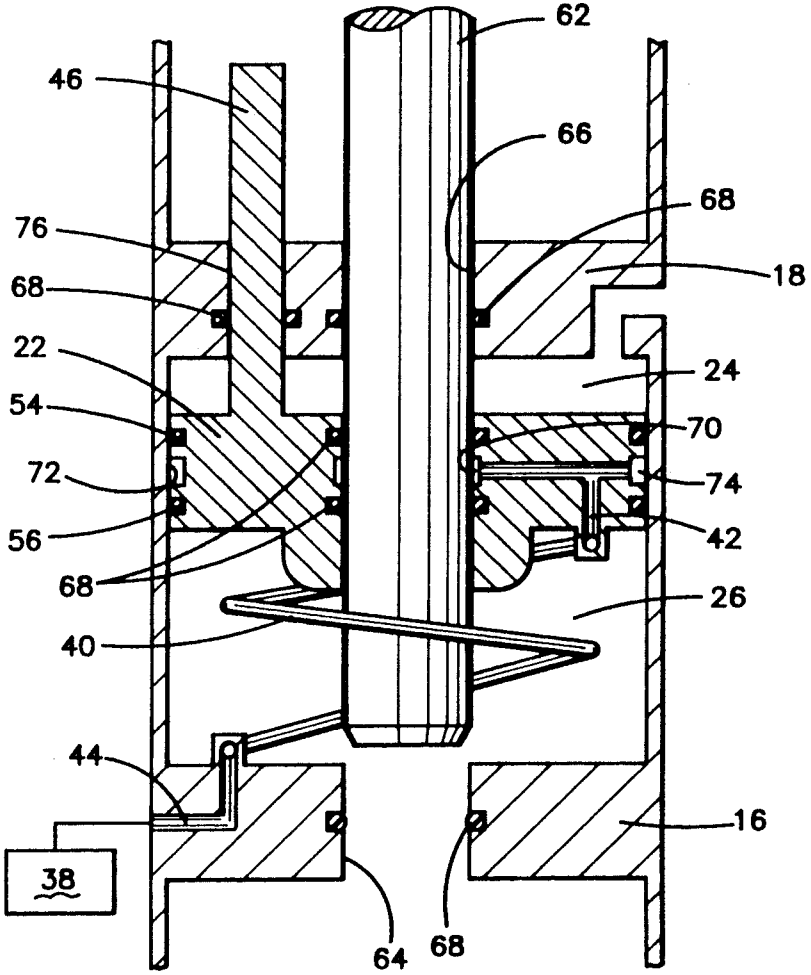
FIG. 2 is a sectional view of the isolation system of the present invention in accordance with FIG. 1 illustrating a variation thereof.

FIG. 2 is a cross sectional view of a variant of the embodiment of the isolation system of FIG. 1. For convenience purposes like elements in FIG. 2 have been designated by like reference numerals. With reference to FIG. 2, piston 22 is provided with a thru bore 60 which receives therein a piston rod 62 which is mounted for reciprocal movement within the thru bore 60. The end walls 16 and 18 are likewise provided with thru bores 64 and 66 respectively, through which the piston rod 62 may reciprocate. The internal surface of thru bore 60 of piston 22 and thru bores 64 and 66 of end wall 16 and 18 are provided with seals 68 for sealing the piston rod 62 within the respective bores 60, 64 and 66.

In accordance with the present invention, the isolation system of the variant of FIG. 2 further includes a second enclosed annular space 70 formed by an annular recess 72 provided on the inner surface of bore 60 of piston 22. The enclosed annular space 70 is defined by the recess 72 on the internal surface of the bore 60 of piston 22 and the outer peripheral surface of piston rod 62. Enclosed annular space 70 is communicated with passage 42 in piston 22 by means of passage 74. Passage 42 in turn communicates with flexible conduit 40 and from there to low pressure area 38 via passage 44 in the manner explained above with reference to FIG. 1.

The second enclosed annular space 70 prohibits leakage between the compartments 24 and 26 around the peripheral surface of the piston rod 62 and thru bore 60 in the same manner as does enclosed annular space 36. In the variant of FIG. 2, guide pin 46 is guided within a bore 76 provided in one of the end walls of housing 12.

Figure 3:
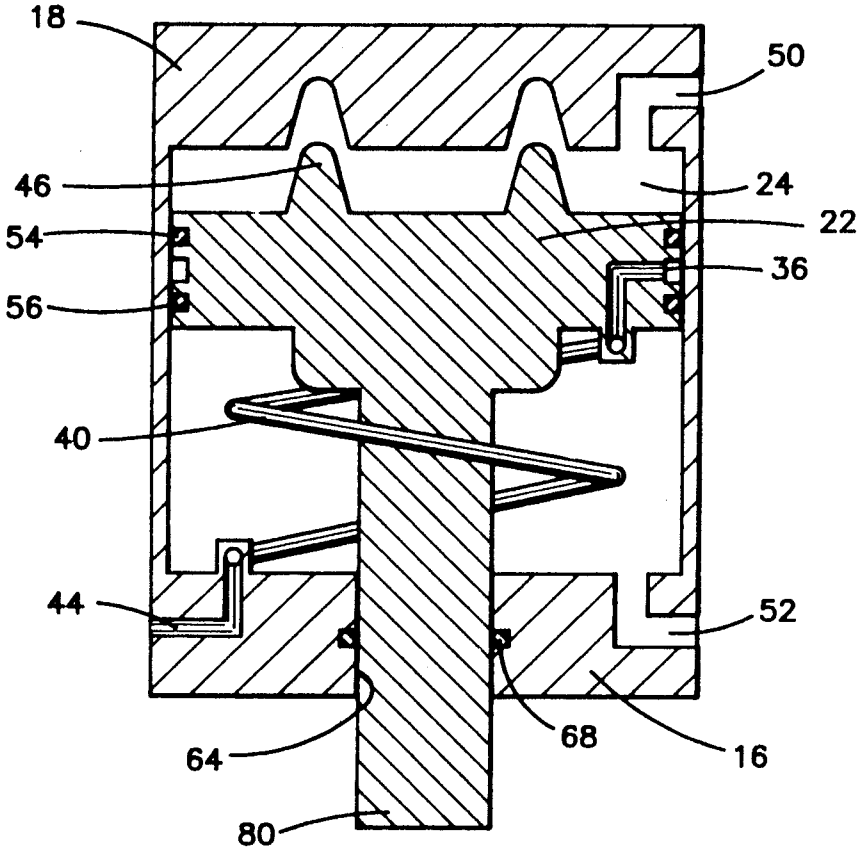
FIG. 3 is a sectional view of the isolation system of the present invention in accordance with FIG. 1 illustrating a further variation thereof.

FIG. 3 is a third variant of the embodiment of the isolation system of FIG. 1 wherein the piston 22 is rigidly secured to a piston rod 80 which projects through a bore 64 provided in end wall 16. The piston rod 80 is sealed within the bore 64 by seal 68 in the same manner as described above with regard to FIG. 2. The piston rod 80 may be connected to any motor tool and may be driven by piston 22 to function as a ram, press or the like.

Figure 4:
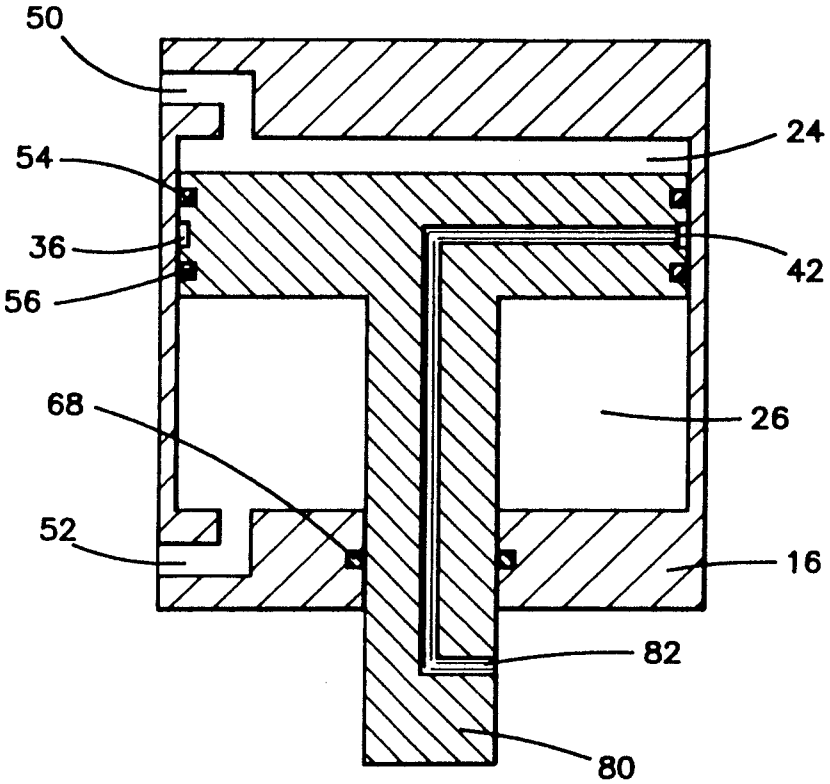
FIG. 4 is a sectional view of a further embodiment of the isolation system of the present invention.

FIG. 4 illustrates a second embodiment of an isolation system in accordance with the present invention. Again, as was the case with FIGS. 1 and 3 above, like elements are designated by like reference numerals. In accordance with the embodiment of FIG. 4, instead of providing a flexible conduit 40 for communicating annular space 36 with low pressure area 38, the communication is formed via a passage in piston rod 80. In the embodiment of FIG. 4 the piston rod 80 is sealed within end wall 16 by means of seal 68. The isolation system of FIG. 4 functions in the same manner as the isolation system described above with regard to FIGS. 1 and 3.

Figure 6:
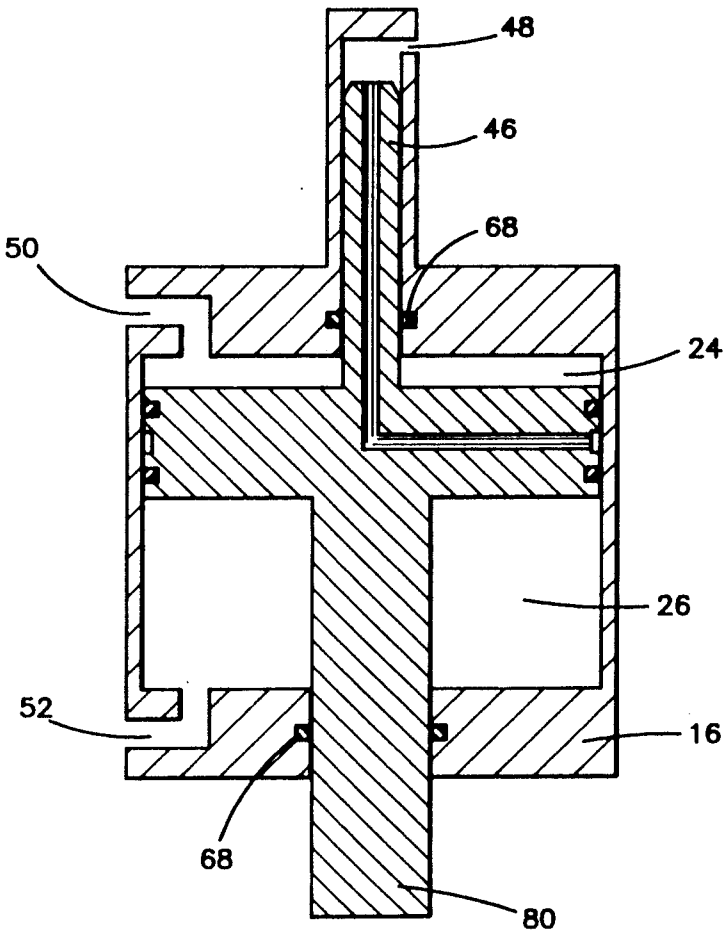
FIG. 6 is a sectional view of the isolation system of the present invention in accordance with FIG. 4 illustrating a further variation thereof.
Figure 5:
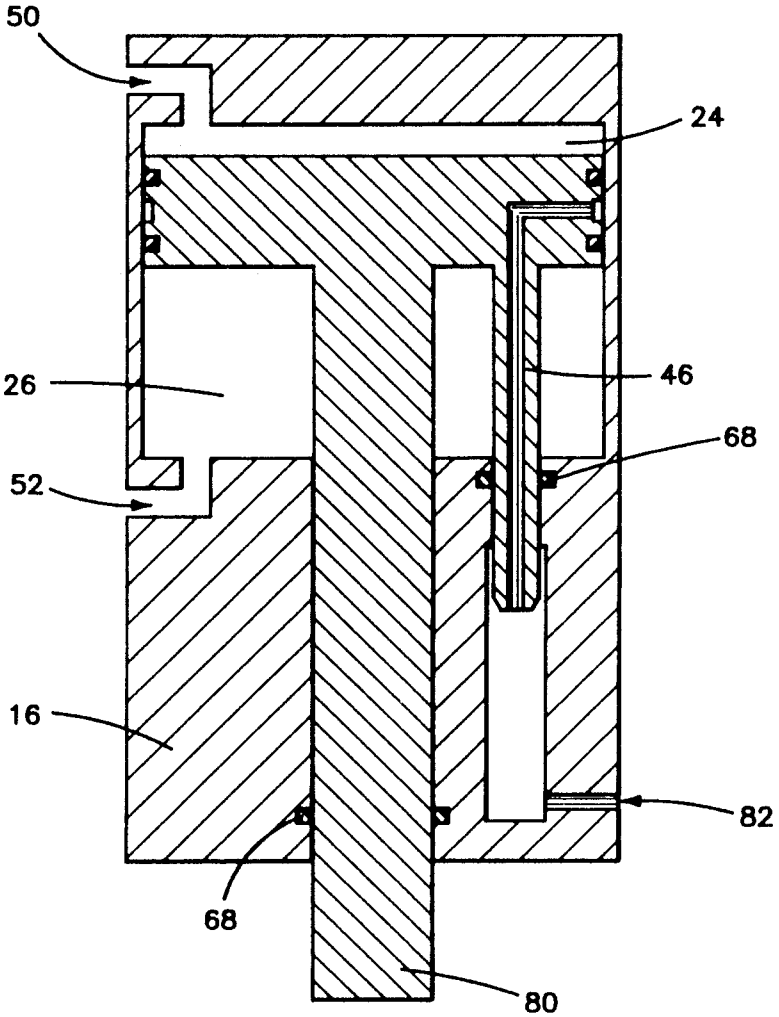
FIG. 5 is a sectional view of the isolation system of the present invention in accordance with FIG. 4 illustrating a variation thereof.

FIG. 5 is a variant of the embodiment of FIG. 4 wherein the communication between enclosed annular space 36 and low pressure area 38 is made via a passage 84 formed within the guide pin 46 fixed on piston 22. FIG. 6 shows a further variant wherein the guide pin 46 is provided on the end face of the piston 22 in opposition to the end face which carries piston rod 80. Again, the variants of FIGS. 5 and 6 function in the same manner as the isolation system of FIG. 4.

Figure 7:
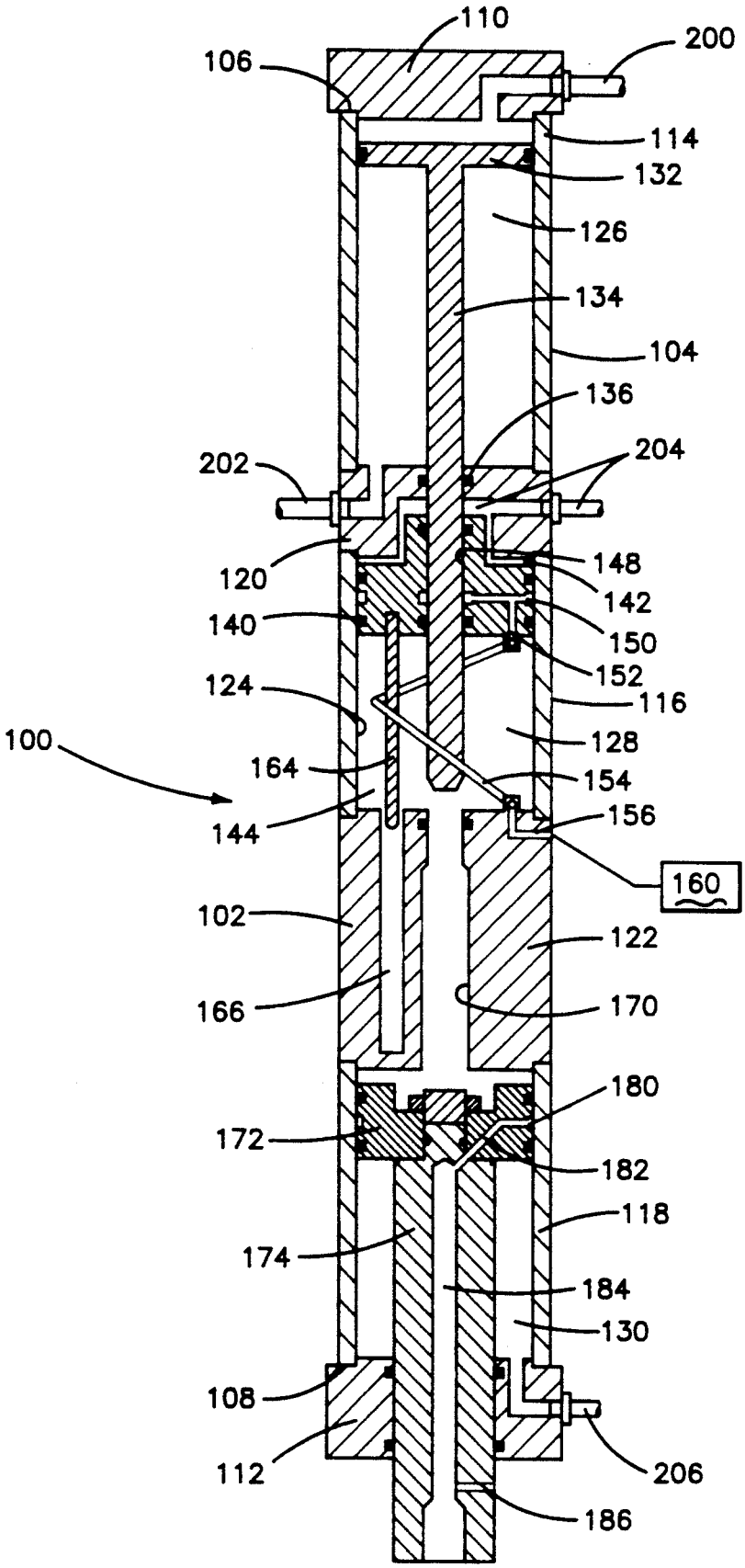
FIG. 7 is a detailed sectional view of a multi-piston air-oil pressure intensifier employing the embodiments of the isolation system of FIGS. 2 and 4 of the present invention for prohibiting leakage between and intermixing of the air and oil.

FIG. 7 is a detailed sectional view of a multi-piston air-oil pressure intensifier employing two embodiments of the isolation system of the present invention for prohibiting leakage and intermixing of the air and oil. FIG. 7 will be described and is illustrated employing the isolation system of the embodiment of FIGS. 2 through 4; however, it should be appreciated that the system of FIGS. 1-3, 5 and 6 could likewise be employed in the pressure intensifier illustrated in FIG. 7.

With reference to FIG. 7, an air-oil pressure intensifier is illustrated in cross section. The air-oil pressure intensifier 100 comprises a housing structure 102 consisting of an elongated side wall portion 104 having first and second ends 106 and 108 provided with closure caps 110, 112. As illustrated in FIG. 7, the side wall of the housing comprises three discreet substantially cylindrical elongated cylinders 114, 116, 118, which are joined together by first and second dividing walls 120 and 122 for dividing the internal space 124 of the housing into first, second and third chambers 126, 128 and 130 respectively. First chamber 126 is defined between closure cover 110 and dividing wall 120, the second chamber 128 is defined between dividing wall 120 and dividing wall 122 and the third chamber is defined between dividing wall 122 and closure cover 112. It should be appreciated that the housing structure need not comprise the three separate cylindrical side wall portions as described above. The housing could be formed from a single cylindrical body or the discreet cylindrical bodies as described above. The housing need only be formed so as to form the required first, second and third chambers 126, 128 and 130 as described above.

Mounted within first chamber 126 for reciprocal motion, in a manner to be described herein below, is motor piston 132 which carries a piston rod 134 which passes through a thru bore 136 provided in dividing wall 120 such that the free end of the piston rod 134 projects into the second chamber 128.

In accordance with one embodiment of the present invention, a free floating piston 140 is mounted within the second chamber 128 for dividing the second chamber into a first fluid containing compartment 142 and a second fluid containing compartment 144. The free floating piston is provided with a thru bore 148 which receives the free end of piston rod 134 which projects through end wall 120 in the second chamber 128. The free floating piston 140 is constructed with an isolation system of the type described above with regard to, for example, FIG. 2. The free floating piston 140 has a peripheral wall surface contacting the side wall 116. The peripheral wall surface is provided with a continuous annular recess thereon which defines with side wall 116 an enclosed annular space 150. The annular space 150 is communicated to low pressure area 160 by means of passage 152, flexible tube 154 and passage 156 provided in divide wall 122. The isolation system, as described above with regard to FIG. 2, is provided with a further enclosed annular recess 162 on the internal surface of thru bore 148 provided in floating piston 140. One end face of the free floating piston 140 is provided with a guide pin 164 received within a recess 166 within divide wall 122. The isolation system 150, 152, 154, 156 and 162 insures that the fluid mediums contained in compartments 142 and 144 do not leak around the floating piston 140 and intermix with each other in the manner described above.

Divide wall 122 is provided with a thru bore 170 which communicates with compartment 144 in second chamber 128. Thru bore 170 receives the free end of piston rod 134 when motor piston 132 is driven downwardly as illustrated in FIG. 7 in a manner to be explained herein below. Mounted within third chamber 130 is ram piston 172 provided with a ram head 174 extending therefrom through a bore provided in closure cover 112. The portion of the ram head 174 extending exteriorly of the housing 102 may be provided in known manner with a tool for operating on a workpiece.

With reference to FIG. 7 and FIGS. 8(*a*) through 8(*e*), the sequence of operation of the intensifier employing an isolation system of the present invention will be described in detail.

As is known in the art, compartment 128 is charged with a volume of incompressible fluid, such as oil, so as to fill the space defined between the under side of free floating piston 140 and the top side of ram piston 172. Thus, the oil reservoir space between pistons 140 and 172 is totally filled with oil and free of air. Compressed air inlets 200, 202, 204 and 206 are provided for feeding and exhausting compressed air to the air-oil pressure intensifier for operating same in a manner described below.

Figures 8A, 8B, 8C, 8D, 8E:
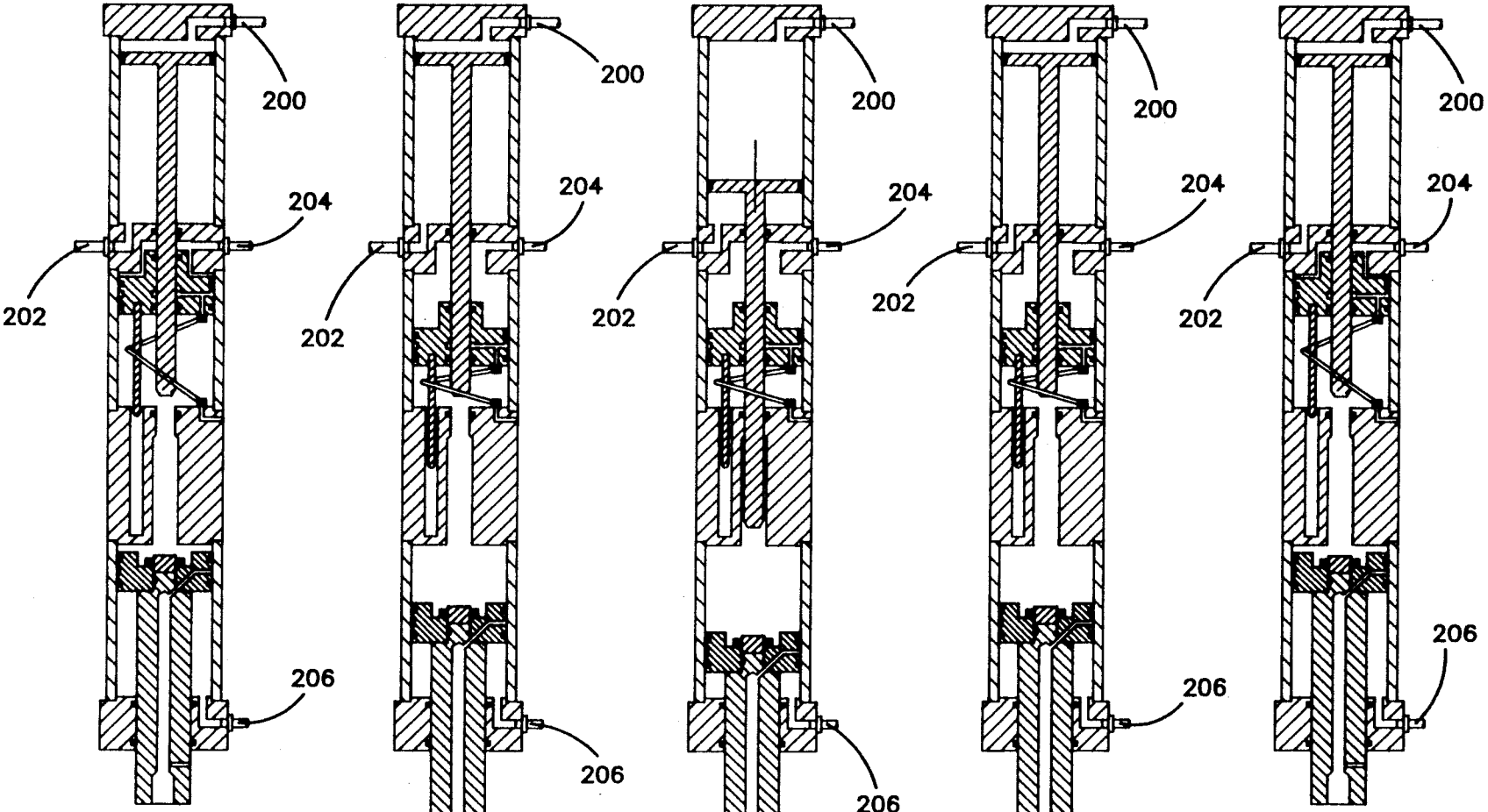
FIGS. 8(*a*)–(*e*) is a series of sectional views showing the operating sequence of the pressure intensifier of FIG. 7.

With reference to FIG. 8, FIG. 8(*a*) illustrates the air-oil pressure intensifier in its retracted, non-working, position. In the position shown in FIG. 8A compressed air is supplied to the under side of motor piston 132 via conduit 202 and to the under side of ram piston 172 via conduit 206 for holding the pistons 132 and 172 in their retracted positions. In this position conduits 200 and 204 are exhausted to atmosphere. As noted above, the entire volume of space between floating piston 140 and ram piston 172 is filled with oil or some other non-compressible medium and is free of air.

During the start-up of operation of the pressure intensifier as shown in FIG. 8(*b*), compressed air is delivered to compartment 142 above floating piston 140 via conduit 204 and at the same time conduit 206 is exhausted to atmosphere so as to drain compressed air from the under side of ram piston 172. The compressed air in compartment 142 acts on free floating piston 140 and transfers the energy thereof through the oil medium to the top side of ram piston 172. The force on free floating piston 140 advances the free floating piston and, correspondingly, the ram piston in a first direction until ram rod 174 is stopped by contact with, for example, a workpiece. As can be seen in FIG. 8(*c*), compressed air is then fed via conduit 200 over motor piston 132 while conduit 202 is exhausted to atmosphere. The force of the compressed air over motor piston 132 drives the motor piston and correspondingly piston rod 134 into through passage 170 where the rod is sealed in the passage 170, thereby isolating low pressure oil compartment 144 from the high pressure oil compartment defined between the free end of the piston rod 134 and the ram piston 172. As a result of the differences in diameter between motor piston 132 and piston rod 134, the pressure generated on ram piston 172 can be intensified which drives the ram head 174 in a high pressure stroke for carrying out work on a workpiece. After the high pressure stroke is completed, conduits 200 and 204 are exhausted to atmosphere and compressed air is delivered to conduits 202 and 206 for retracting pistons 132, 140 and 172 to their retracted position as shown in FIG. 8(*e*).

The isolation system of the present invention as illustrated and described in FIGS. 1 through 7 prohibits leakage of compressed air or oil around the peripheral surface of a piston between the respective air and oil compartments, thereby avoiding the intermixing of air with the oil which, as pointed out above, has an adverse effect on the operating efficiency of the pressure intensifier. In accordance with the present invention, ram piston 172 of the pressure intensifier 100 may likewise be provided with an isolation system of the present invention. As shown in FIG. 7, chamber 180 may be provided in the peripheral wall surface of piston 172 and communicated to the low pressure area via conduits 182, 184 and 186. By providing the isolation system of the present invention in a pressure intensifier of the type described above and disclosed in U.S. Pat. Nos. 4,271,671, 4,300,351 and 4,993,226, the problem with leakage and intermixing of air with oil is eliminated.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A system for isolating two diverse fluid mediums in a chamber so as to prohibit intermixing of the diverse fluid mediums comprising:

means for defining a stationary chamber including a substantially cylindrical elongated side wall and a pair of opposed end walls which define with said side wall said chamber;

a piston movably mounted within said chamber for dividing said chamber into a first fluid medium compartment and a second fluid medium compartment, said piston having a first end face, a second end face and a peripheral wall surface extending between said end faces which sealingly mates with said side wall for sealing said first compartment from said second compartment, said peripheral wall surface having a continuous annular recess formed therein which defines with said side wall an enclosed annular space between said end faces of said piston; and conduit means for communicating said enclosed annular space with an area external of said chamber for creating a pressure differential between said enclosed annular space and said area which allows fluid medium in the annular space to escape to the external area thereby prohibiting the fluid medium in one of said first and second fluid medium compartments from leaking into the other of said first and second fluid medium compartments, said conduit means includes a flexible tube mounted within one of said first and second fluid compartments and having one end connected to said movable piston and another end connected to said stationary chamber whereby said flexible tube expands and contracts within said one fluid compartment as said piston moves in said chamber.

2. A system according to claim 1 wherein said piston is free floating.

3. A system according to claim 1 including a piston rod connected to one end face of said piston wherein said piston rod projects out of said chamber through one of said pair of end walls.

4. A system according to claim 2 including guide means connected to one end face of said piston and wherein one of said pair of end walls is provided with a recess for receiving said guide means.

5. A system according to claim 3 including guide means connected to one end face of said piston and wherein one of said pair of end walls is provided with a recess for receiving said guide means.

6. A system according to claim 4 wherein said guide means and piston rod are connected to a same end face of the piston.

7. A system according to claim 4 wherein said guide means and piston rod are connected to a different end face of the piston.

8. A system according to claim 1 wherein a pair of annular piston seals are provided on said peripheral wall surface, one on either side of said enclosed annular space.

9. A system according to claim 2 wherein a pair of annular piston seals are provided on said peripheral wall surface, one on either side of said enclosed annular space.

10. A system according to claim 3 wherein a pair of annular piston seals are provided on said peripheral wall surface, one on either side of said enclosed annular space.

11. A system according to claim 4 wherein said recess includes a drain port.

12. A system according to claim 1 including first means for providing oil in one said first and second compartments and second means for providing air in the other of said first and second compartments.

13. A system according to claim 2 wherein said piston is provided with a thru bore extending between the first and second end faces and a rod is reciprocally mounted within said thru bore and extends through one of said pair of opposed end walls, said one end wall defining with a cylindrical side wall and a closure cover a second chamber, and a motor piston reciprocally mounted within said second chamber and fixed to one end of said rod.

14. A system according to claim 13 wherein the other of said pair of opposed end walls is provided with a bore for receiving the other end of said rod, said bore communicating one of said first and second fluid medium compartments with a third chamber, said third chamber including ram means for performing work on a work piece.

15. A system according to claim 14 wherein said one of said first and second fluid medium compartments is provided with oil and the other of said first and second fluid medium compartments is selectively communicated to a source of air under pressure for moving said ram means in a first direction.

16. A system according to claim 15 wherein said motor piston is selectively communicated to a source of air under pressure for driving said end of the rod within the bore for further moving said ram means in said first direction.

17. An air-oil pressure intensifier comprising:

a housing having a side wall means and first and second cap ends each provided with first and second closure covers respectively which define with the side wall means an internal housing space;

first and second stationary end walls located in the internal housing space in spaced apart relationship so as to divide said housing space into a first, second and third chamber wherein the first chamber is defined between said first closure cover and said first end wall, the second chamber is defined between said first end wall and said second end wall and said third chamber is defined between said second end wall head and said second closure cover;

a free floating piston movable mounted in said second chamber for dividing said second chamber into a first compartment and a second compartment, said free floating piston having a first end face, a second end face and a peripheral wall surface extending between said end faces which sealingly mates with said side wall means for sealing said first compartment from said second compartment, said peripheral wall surface having a continuous annular recess formed therein which defines with said side wall means an enclosed annular space between said end faces of said piston; and conduit means for communicating said enclosed annular space with an area external of said chamber for creating a pressure differential between said annular groove and said area which allows fluid medium in the annular space to escape to the external area thereby prohibiting the fluid medium in one of said first and second fluid medium compartments from leaking into the other of said first and second fluid medium compartments.

18. A device according to claim 17 wherein said free floating piston is provided with a first thru bore.

19. A device according to claim 18 wherein said first end wall is provided with a second thru bore which is axially aligned with the thru bore in said floating piston.

20. A device according to claim 19 wherein a motor piston is reciprocally mounted in said first chamber, a piston rod having a first end connected to said motor piston and a second end wherein said piston rod is mounted in said second and first thru bores and reciprocally movable therein.

21. A device according to claim 20 wherein said second end wall is provided with a third thru bore aligned with said first and second thru bores for receiving the second end of said piston rod.

22. A device according to claim 21 wherein said third chamber includes ram means movable mounted therein wherein said one of said first and second fluid medium compartments is provided with oil and the other of said first and second fluid medium compartments is selectively communicated to a source of air under pressure for moving said ram means in a first direction said motor piston is selectively communicated to a source of air under pressure for driving said end of the rod within the bore for further moving said ram means in said first direction.

* * * * *